US008087843B2

(12) United States Patent
Ottaviani et al.

(10) Patent No.: US 8,087,843 B2
(45) Date of Patent: Jan. 3, 2012

(54) LIQUID DENTIFRICE DISPENSING TOOTHBRUSH

(76) Inventors: Frank Ottaviani, Astoria, NY (US); Todd Spinelli, Astoria, NY (US)

( * ) Notice: Subject to any disclaimer, the term of this patent is extended or adjusted under 35 U.S.C. 154(b) by 311 days.

(21) Appl. No.: 12/435,571

(22) Filed: May 5, 2009

(65) Prior Publication Data

US 2010/0284726 A1 Nov. 11, 2010

(51) Int. Cl.
*A46B 11/02* (2006.01)
*A61C 17/00* (2006.01)

(52) U.S. Cl. ..... 401/188 R; 401/278; 15/22.1

(58) Field of Classification Search ..... 401/188 R, 401/278; 15/22.1
See application file for complete search history.

(56) References Cited

U.S. PATENT DOCUMENTS

| | | | | | |
|---|---|---|---|---|---|
| 805,733 | A | * | 11/1905 | Key | 401/21 |
| 841,946 | A | * | 1/1907 | Downing | 401/278 |
| 1,212,010 | A | * | 1/1917 | Brown | 401/182 |
| 1,518,341 | A | * | 12/1924 | Mendoza | 401/286 |
| 1,676,601 | A | | 7/1928 | Cavanaugh | |
| 2,547,834 | A | * | 4/1951 | Perwas | 222/191 |
| 2,587,794 | A | * | 3/1952 | Walker et al. | 222/378 |
| 2,628,001 | A | * | 2/1953 | Sarnoff | 222/209 |
| 2,743,042 | A | | 4/1956 | Burgin | |
| 2,807,818 | A | | 10/1957 | Taylor | |
| 3,256,894 | A | * | 6/1966 | Sherman | 401/176 |
| 3,400,996 | A | * | 9/1968 | Vandergrift | 401/184 |
| 3,400,999 | A | * | 9/1968 | Goldstein | 433/82 |
| 3,864,047 | A | * | 2/1975 | Sherrod | 401/278 |
| 3,903,888 | A | * | 9/1975 | Buelow et al. | 604/186 |
| 4,124,316 | A | * | 11/1978 | O'Rourke | 401/184 |
| 4,236,651 | A | | 12/1980 | Meyer et al. | |
| 4,277,194 | A | * | 7/1981 | Smith | 401/173 |
| 4,685,819 | A | * | 8/1987 | Endo | 401/176 |
| 4,692,047 | A | * | 9/1987 | Endo | 401/141 |
| 4,875,791 | A | | 10/1989 | Hassan | |
| 5,301,381 | A | * | 4/1994 | Klupt | 15/22.1 |
| 5,309,590 | A | * | 5/1994 | Giuliani et al. | 15/22.1 |
| 5,338,124 | A | * | 8/1994 | Spicer et al. | 401/280 |
| 5,346,324 | A | | 9/1994 | Kuo | |
| 5,382,106 | A | | 1/1995 | Voigt | |
| 5,393,153 | A | * | 2/1995 | Bouthillier et al. | 401/146 |
| 5,407,287 | A | * | 4/1995 | Braun et al. | 401/176 |
| 5,769,585 | A | | 6/1998 | Podolsky | |
| 5,827,001 | A | * | 10/1998 | Taghavi-Khanghah | 401/145 |
| 5,909,977 | A | | 6/1999 | Kuo | |
| 5,918,995 | A | | 7/1999 | Puurunen | |
| 6,039,489 | A | * | 3/2000 | Harman et al. | 401/146 |
| 6,142,694 | A | * | 11/2000 | Rivlin et al. | 401/181 |
| 6,179,503 | B1 | * | 1/2001 | Taghavi-Khanghah | 401/184 |
| 6,241,412 | B1 | | 6/2001 | Spies et al. | |
| 6,406,207 | B1 | * | 6/2002 | Wiegner et al. | 401/272 |
| 6,679,642 | B1 | | 1/2004 | Dillingham et al. | |
| 6,685,375 | B1 | * | 2/2004 | Crocker | 401/176 |
| 6,719,471 | B1 | * | 4/2004 | Giro | 401/188 R |
| 6,948,875 | B1 | | 9/2005 | Jang | |

(Continued)

FOREIGN PATENT DOCUMENTS

| | | |
|---|---|---|
| CA | 523340 | 4/1956 |

(Continued)

*Primary Examiner* — Robert Canfield
(74) *Attorney, Agent, or Firm* — Michael I. Kroll

(57) ABSTRACT

A dentifrice dispensing toothbrush for applying a predetermined measured amount of liquid dentifrice from a reservoir of liquid dentifrice into the toothbrush bristles by means of an in integral pump. Liquid dentifrice may be refilled using the handle portion of the toothbrush.

6 Claims, 9 Drawing Sheets

U.S. PATENT DOCUMENTS

| | | | | |
|---|---|---|---|---|
| 7,021,851 | B1 * | 4/2006 | King | 401/291 |
| 7,244,073 | B2 * | 7/2007 | Trocino | 401/277 |
| 2003/0150472 | A1 * | 8/2003 | Johnson | 132/311 |
| 2007/0110503 | A1 * | 5/2007 | Glover | 401/134 |
| 2008/0089733 | A1 * | 4/2008 | Lochak | 401/180 |
| 2008/0205970 | A1 * | 8/2008 | LaFlamme et al. | 401/205 |
| 2009/0119859 | A1 * | 5/2009 | Podolsky | 15/167.1 |
| 2009/0136285 | A1 * | 5/2009 | Hall et al. | 401/282 |
| 2010/0175214 | A1 * | 7/2010 | Payet | 15/167.1 |
| 2010/0272500 | A1 * | 10/2010 | Martin et al. | 401/277 |

FOREIGN PATENT DOCUMENTS

| | | | |
|---|---|---|---|
| FR | 2 915 066 | A1 * | 10/2008 |
| GB | 864439 | | 4/1961 |
| GB | 2.215.593 | | 9/1989 |
| GB | 2 392 377 | A * | 3/2004 |
| WO | 2006/019289 | A1 * | 2/2006 |
| WO | 2010/128975 | A1 * | 11/2010 |

* cited by examiner

LIQUID DENTIFRICE DISPENSING TOOTHBRUSH

BACKGROUND OF THE INVENTION

1. Field of the Invention

The present invention relates generally to toothbrush and, more specifically, to a liquid dentifrice dispensing toothbrush for applying a measured dose of liquid dentifrice from a reservoir of liquid dentifrice into the toothbrush bristles by means of an integral pump.

2. Description of the Prior Art

There are other tooth brushing devices designed for dispensing dentifrice. Typical of these is U.S. Pat. No. 1,676,601 issued to Cavanaugh on Jul. 10, 1928.

Another patent was issued to Burgin on Apr. 24, 1956 as U.S. Pat. No. 2,743,042. Yet another U.S. Pat. No. 2,807,818 was issued to Taylor on Oct. 1, 1957 and still yet another was issued on Dec. 2, 1980 to Meyer et al. as U.S. Pat. No. 4,236,651.

Another patent was issued to Hassan on Oct. 24, 1989 as U.S. Pat. No. 4,875,791. Yet another U.S. Pat. No. 5,346,324 was issued to Kuo on Sep. 13, 1994. Another was issued to Voight on Jan. 17, 1995 as U.S. Pat. No. 5,382,106 and still yet another was issued on Jun. 23, 1998 to Podolsky as U.S. Pat. No. 5,769,585.

Another patent was issued to Kuo on Jun. 8, 1999 as U.S. Pat. No. 5,909,977. Yet another U.S. Pat. No. 5,918,995 was issued to Puurunen on Jul. 6, 1999. Another was issued to Spies et al. on Jun. 5, 2001 as U.S. Pat. No. 6,241,412 and still yet another was issued on Jan. 20, 2004 to Dillingham et al. as U.S. Pat. No. 6,679,642.

Another patent was issued to Jang on Sep. 27, 2005 as U.S. Pat. No. 6,948,875. Yet another Canadian Patent No. CA523340 was issued to Neuls on Apr. 3 1961. Another was issued to Horitz on Apr. 6, 1961 as U.K. Patent No. GB864, 439 and still yet another was issued on Sep. 27, 1989 to Douglas as U.K. Patent No. GB2215593.

U.S. Pat. No. 1,676,601

Inventor: Leo C. Cavanaugh

Issued: Jul. 10, 1928

This invention relates to an improvement in fountain toothbrushes. A soft, cleansing, and antiseptic brush is provided for the teeth and gums, which is antiseptically self-filled and may be easily and quickly used for cleansing the teeth.

U.S. Pat. No. 2,743,042

Inventor: Luther B. Burgin

Issued: Apr. 24, 1956

This invention relates in general to improvements in tooth brushes, more particular to an improved fountain tooth brush. This invention provides an improved tooth brush which includes a handle containing tooth brush, the handle having associated therewith a pump for pumping tooth paste into a hollow head portion of the tooth brush for supplying tooth paste to bristles thereof.

U.S. Pat. No. 2,807,818

Inventor: Christopher L. Taylor

Issued: Oct. 1, 1957

The present invention relates to improvements in toothbrushes, and more particularly to an improved combined toothbrush dentifrice dispenser. The main object to the invention is to provide an improved combination toothbrush and dentifrice dispenser which is adapted for use with either a liquid dentifrice, a powdered dentifrice, or a toothpaste.

U.S. Pat. No. 4,236,651

Inventor: Walter Meyer et al.

Issued: Dec. 2, 1980

A dispenser device comprising a reservoir for a flowable or fluent filled material as well as a piston pump equipped with a valve arrangement. The valve arrangement is coaxially dispositioned with regard to the pump and possesses parts connected with the piston and parts connected with the cylinder of the piston pump.

U.S. Pat. No. 4,875,791

Inventor: Shawky A. Hassan

Issued: Oct. 24, 1989

A liquid dispensing brush primarily used in dispensing liquid cleanser. The brush includes a reservoir which holds a predetermined amount of liquid cleanser and an arm with a longitudinal passage to deliver the cleanser from the reservoir to the head of the brush. The head of the brush comprises several sets of bristles and outlet means to allow the liquid cleanser to flow from the longitudinal passage to the bristles. In order to effectuate the flow of liquid cleanser from the reservoir to the bristles, means are provided whereby the brush is tilted to raise the reservoir higher than the head of the brush. A cap, with a flexible clip for easy storage, provides the tilting necessary to effectuate fluid flow. In use, the brush is placed on a flat surface in the tilted position for a predetermined length of time to allow a sufficient amount of liquid cleanser to flow to the bristles.

U.S. Pat. No. 5,346,324

Inventor: Youti Kuo

Issued: Sep. 13, 1994

A dentifrice dispensing toothbrush is described which utilizes a compressible elastic button to pump a controlled quantity of dentifrice material from a replaceable cartridge to the brush head. The toothbrush locks itself to prevent further pumping of dentifrice material when its replaceable cartridge is nearly empty. The self locking mechanism eliminates the formation of voids in the dentifrice material and consequent pump failure when the spent cartridge is replaced. In one embodiment, a cover is provided which protects the brush head, bristles, pumping mechanism and other parts of the toothbrush. The cover also seals the conduit which supplies dentifrice material to the brush head to prevent it from becoming clogged with dried dentifrice material during periods of non use and to prevent accidental compression of the button. The compressible elastic button is part of a pump assembly which also includes a pump chamber, a partition which divides the pump chamber into an intake compartment and a discharge compartment, a one way check valve for an opening in the base of the pump chamber to control the flow of dentifrice material from the cartridge to the pump chamber and an opening in the partition between the intake and discharge compartments. A plug is attached to the top of a follower disc which is positioned in the cartridge. When the cartridge is nearly depleted, the plug locks the toothbrush by blocking the dispensing movement of the dentifrice material.

U.S. Pat. No. 5,382,106

Inventor: Bernard Voigt

Issued: Jan. 17, 1995

An improved toothbrush with a teeth cleansing substance dispensing system is provided, which consists of a mechanism in cooperation with a compartment in an enlarged handle, which will dispense some teeth cleansing substance through a channel in a neck and head and out through at least one lateral passageway into bristle groups, so that the bristle groups can clean teeth. An apparatus is also in cooperation with the channel in the head and neck for sealing the at least one lateral passageway, when not in use. This stops the flow of the teeth cleansing substance and prevents germs, bacteria, water and other foreign elements from contaminating the teeth cleansing substance left in the channel and the compartment.

U.S. Pat. No. 5,769,585

Inventor: Grigory Podolsky

Issued: Jun. 23, 1998

A toothbrush is formed with a resilient annular pump having a conical chamber formed by an inner annular surface of the pump and two axially spaced and swingable flap valves inclined with respect to the longitudinal axis of the toothbrush in respective closing positions thereof and with a projection between a piston of the pump an one of the flap valves preventing automatic delivery of the paste into the chamber and creating sufficient pressure for pushing the paste toward the bristles.

U.S. Pat. No. 5,909,977

Inventor: Youti Kuo

Issued: Jun. 8, 1999

A dentifrice dispensing toothbrush utilizes a refillable cartridge for storing dentifrice material and a compressible elastic button for pumping dentifrice material from the cartridge to a brush head. The refillable cartridge has special adaptive features for mounting to different sized openings of toothpaste tubes to facilitate cartridge refilling and venting entrapped air. The essential components of the dentifrice dispensing toothbrush include 1) a brush head having an outlet opening therethrough and a series of bristles; 2) a pump assembly which has a pump chamber, an elastic compressible button and a base having a flap check valve; 3) a housing for attaching a refillable cartridge; 4) a refillable cartridge having an adaptive annular lip on its top opening for mating with the opening of a toothpaste tube and a plurality of shallow grooves for venting entrapped air, and a two-way follower disc for packing the dentifrice material. The dentifrice dispensing toothbrush optionally includes 5) a venting flip-cap for attachment to a toothpaste tube for releasing entrapped air when a cartridge is being refilled; and 6) a brush cover which seals the outlet opening of the brush head.

U.S. Pat. No. 5,918,995

Inventor: Juha-Pekka Puurunen

Issued: Jul. 6, 1999

A pump toothbrush includes a brush portion, a grip portion and an intermediate arm portion. The grip portion includes a container portion for dental cleansing medium and is connected to the brush portion by way of a pump device to feed the dental cleansing medium into the brush portion through the intermediate arm portion. The pump device includes a frame portion that is arranged between the container portion and the arm portion. The frame portion is provided with a recess located perpendicularly with respect to the longitudinal axis of the pump toothbrush. An adjusting body forming an inner portion of the pump device is fitted into the recess in the frame portion. The adjusting body possesses an axial outwards open intermediate space that functions as a chamber in the pump device. The intermediate space in the adjusting body is closed by a flexible pressure membrane. In addition, inlet and outlet valves are arranged in the adjusting body to enable connection between and transfer of dental cleansing medium from the container portion to the brush portion through the inlet and outlet valves when pressure is applied to the flexible pressure membrane.

U.S. Pat. No. 6,241,412

Inventor: Norbert Spies et al.

Issued: Jun. 5, 2001

An improved toothbrush is disclosed having a supply of liquid dentifrice located within the handle of the toothbrush, and a dispenser mechanism for dispensing the stored dentifrice to the bristles of the toothbrush when the need arises. The dentifrice-dispensing toothbrush is adapted to utilize replaceable, dentifrice-storing cartridges. In another preferred embodiment a dentifrice-dispensing toothbrush is provided which is effective in operation, durable, attractive in appearance, and relatively inexpensive to manufacture.

U.S. Pat. No. 6,679,642

Inventor: John B. Dillingham et al.

Issued: Jan. 20, 2004

A toothbrush having a water reservoir in the handle and squeezable to force water therefrom through a plurality of spaced apart orifices located at the base of bristles that project from the head of the brush.

U.S. Pat. No. 6,948,875

Inventor: Hyo Sol Jang

Issued: Sep. 27, 2005

A toothbrush device is provided, which includes a brush, a toothpaste storing case, and a push-button pump disposed between the brush and the toothpaste storing case; a first check valve disposed between the toothpaste storing case and the pump, a second check valve disposed between the first check valve and the toothpaste storing case, and a first spring disposed between the first and second check valves; wherein the first check valve includes a second spring and a piston in sequence in a direction away from the pump, and has a working element which includes a rod with movement grooves at a first end thereof and a securing part at a second end thereof.

Canada Patent Number CA523340

Inventor: Albert W. Neuls

Published: Apr. 3, 1956

Our invention relates to new and useful improvements in tooth brushes, the principal object and essence of our invention being to provide a relatively simply structure whereby the dentifrice is adapted to be stored within a disposable receptacle which acts as the handle of the tooth brush and is dispensed by plunger action to the bristle area.

U.K. Patent Number GB864,439

Inventor: Karel Horitz

Published: Apr. 6, 1961

Dentifrice is discharged to the bristles G of a toothbrush from a pressurized container P forming the handle of the brush by screwing the container into a socket F integral with the rear of the stem B of the brush so that the valve M is forced clear of the valve seating N in the discharge nozzle J of the container when the fluted head K of the valve contacts a sealing flange E of a flexible tube C extending through and beyond a bore S in the stem and head of the brush. The valve head and stem are surrounded by a tube of resilient material H that is compressed when the container is screwed into the stem to form with the flange an adequate seal between the container and the stem.

U.K. Patent Number GB2215593

Inventor: George Clark Douglas

Issued: Sep. 27, 1989

The invention relates to a dispensing and applicator device particularly suited for use by handicapped persons. Where a paste is to be applied to a brush or other applicator, say toothpaste onto a brush head, difficulties may be encountered by the disabled or blind. The device comprises a hollow body portion (2) forming a handle, said body portion adapted to contain compositions having a paste or cream-like consistency and to permit extrusion of said compounds from an outlet (6) of said body portion by a manually operated lever or press-button (4), wherein the outlet of the body portion communicates with a hollow dispensing portion (8) the latter being provided with applicator means (14), such as a brush head, there being provided apertures (12) through a wall area of the dispensing portion at said applicator means; giving communication between the interior of the hollow dispensing portion and the applicator means. While these toothbrushes may be suitable for the purposes for which they were designed, they would not be as suitable for the purposes of the present invention, as hereinafter described.

SUMMARY OF THE PRESENT INVENTION

A primary object of the present invention is to provide a liquid dentifrice dispensing toothbrush.

Another object of the present invention is to provide a liquid dentifrice dispensing toothbrush that dispenses a measured amount of liquid dentifrice to the bristles of the toothbrush.

Yet another object of the present invention is to provide a liquid dentifrice toothbrush having housing comprising a handle portion with a removable cap and a head portion.

Still yet another object of the present invention is to provide a liquid dentifrice toothbrush wherein said head portion is removably attached.

A further object of the present invention is to provide a liquid dentifrice toothbrush wherein said head portion has an internal conduit extending from one distal end to at least one aperture located in the bristles of the head portion.

A yet further object of the present invention is to provide a liquid dentifrice toothbrush wherein said handle portion has a reservoir of liquid dentifrice and a pump assembly for dispensing a predetermined amount of the liquid dentifrice.

A still yet further object of the present invention is to provide a liquid dentifrice toothbrush wherein said reservoir of liquid dentifrice is a collapsible bag.

An additional object of the present invention is to provide a liquid dentifrice toothbrush wherein said collapsible bag has a one way valve on one end for refilling the bag and an aperture sealably mateable to the pump thereby forming an airtight reservoir of liquid dentifrice.

Another object of the present invention is to provide a liquid dentifrice toothbrush wherein said pump assembly comprises housing having a nipple, a plurality of chambers and one way valves all in conduit communication and an actuator for creating positive and negative pressure within said pump and thereby moving a predetermined amount of liquid dentifrice from the collapsible bag to a pump egress port.

Yet another object of the present invention is to provide a liquid dentifrice toothbrush wherein said actuator is a pliable button.

Still yet another object of the present invention is to provide a liquid dentifrice toothbrush wherein said pump nipple provides means for attaching the collapsible bag to the pump.

A further object of the present invention is to provide a liquid dentifrice toothbrush wherein said plurality of chambers comprises a dosage chamber and a holding chamber.

A yet further object of the present invention is to provide a liquid dentifrice toothbrush wherein said dosage chamber incorporates the pliable button and a pair of one way valves positioned on each end so that when the button is depressed positive pressure moves the contents of the dosage chamber through an egress one way valve into the holding chamber and upon button release creates a vacuum within the dosage chamber drawing a predetermined amount of liquid dentifrice from the collapsible bag through the ingress one way valve into the dosage chamber.

A still yet further object of the present invention is to provide a liquid dentifrice toothbrush wherein said holding chamber has a one way valve situated on its egress end preventing contamination of its contents between usage's of the liquid dentifrice dispensing toothbrush.

An additional object of the present invention is to provide a liquid dentifrice toothbrush wherein said handle portion has a removable cap providing access to a collapsible bag refill fitting for refilling the liquid dentifrice reservoir.

Another object of the present invention is to provide a liquid dentifrice toothbrush having an attachable refill canister mateable to the collapsible bag refill fitting sealably engaging one to the other for transferring the contents of the dentifrice refill canister into the toothbrush's liquid dentifrice reservoir.

Additional objects of the present invention will appear as the description proceeds.

The present invention overcomes the shortcomings of the prior art by providing a dentifrice dispensing toothbrush which dispenses a predetermined measured amount of liquid dentifrice by means of a pump.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
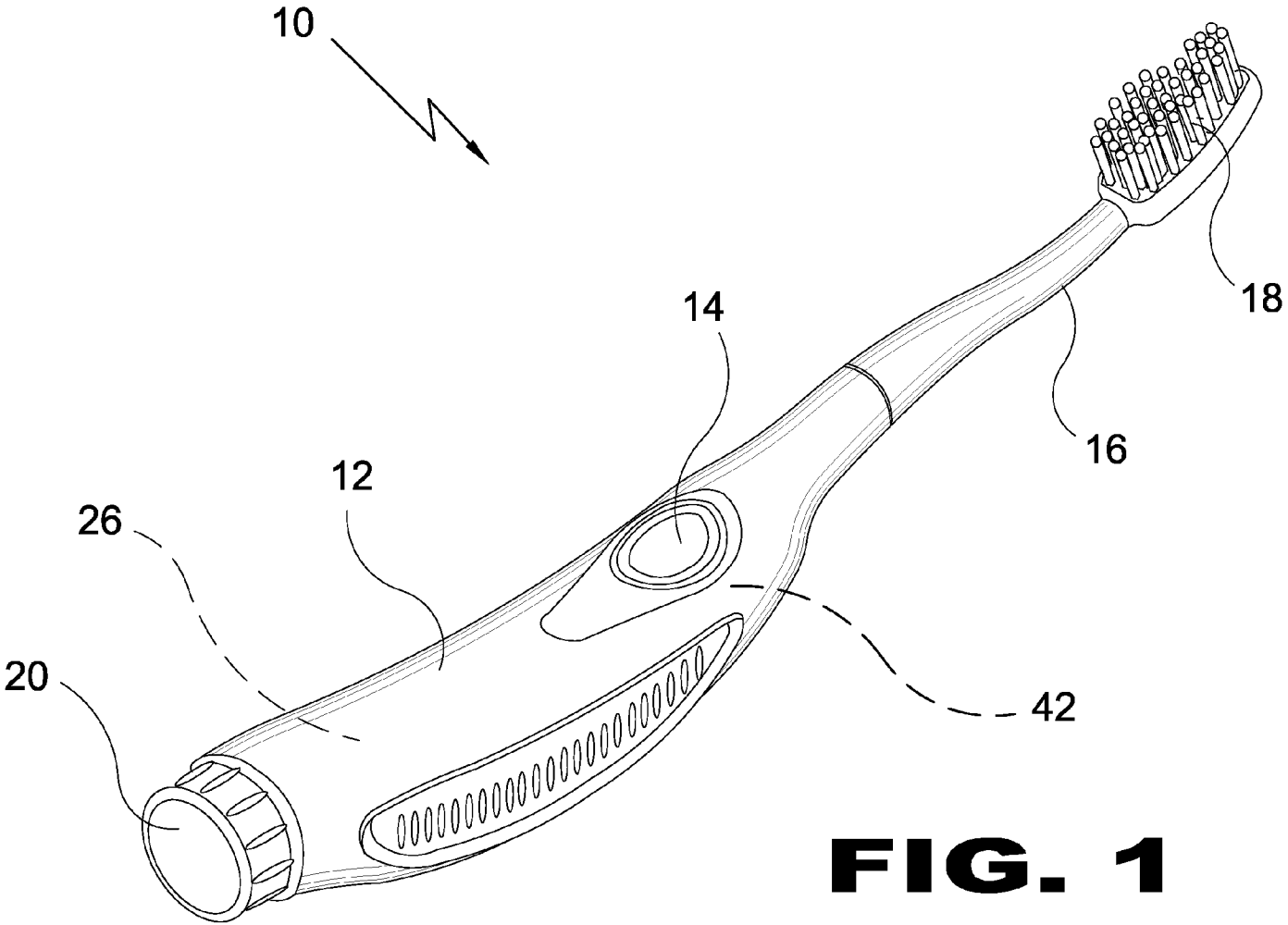
FIG. 1 is a perspective view showing the main components of the present invention including end cap, handle, pump button, head and bristles.

Turning now descriptively to the drawings, in which similar reference characters denote similar elements throughout the several views, the figures illustrate the Liquid Dentifrice Dispensing Toothbrush of the present invention. With regard to the reference numerals used, the following numbering is used throughout the various drawing figures.

Liquid Dentifrice Dispensing Toothbrush of the present invention

12 handle housing
14 pump actuator
16 removable brush head
18 brush bristles
20 end cap
22 check valve
24 flow direction
26 liquid dentifrice
28 conduit
30 brush
32 holding chamber
33 dosage chamber
34 dentifrice collapsible bag
35 dentifrice bag aperture
36 brush bristle aperture
38 liquid dentifrice refill
39 liquid dentifrice refill fastener
40 grip
42 pump assembly
44 cavity
45 pump egress port
46 inlet
48 pump nipple
50 pressure
52 vacuum

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is a perspective view of the present invention 10. Shown is a perspective view of the present invention 10 comprising a toothbrush having a handle portion 12 with end cap 20 and a removable brush head 16 having bristles 18 and a pump assembly 42 with pump actuator 14 for displacing and holding liquid dentifrice 26 integrated into its handle 12.

Figure 2:
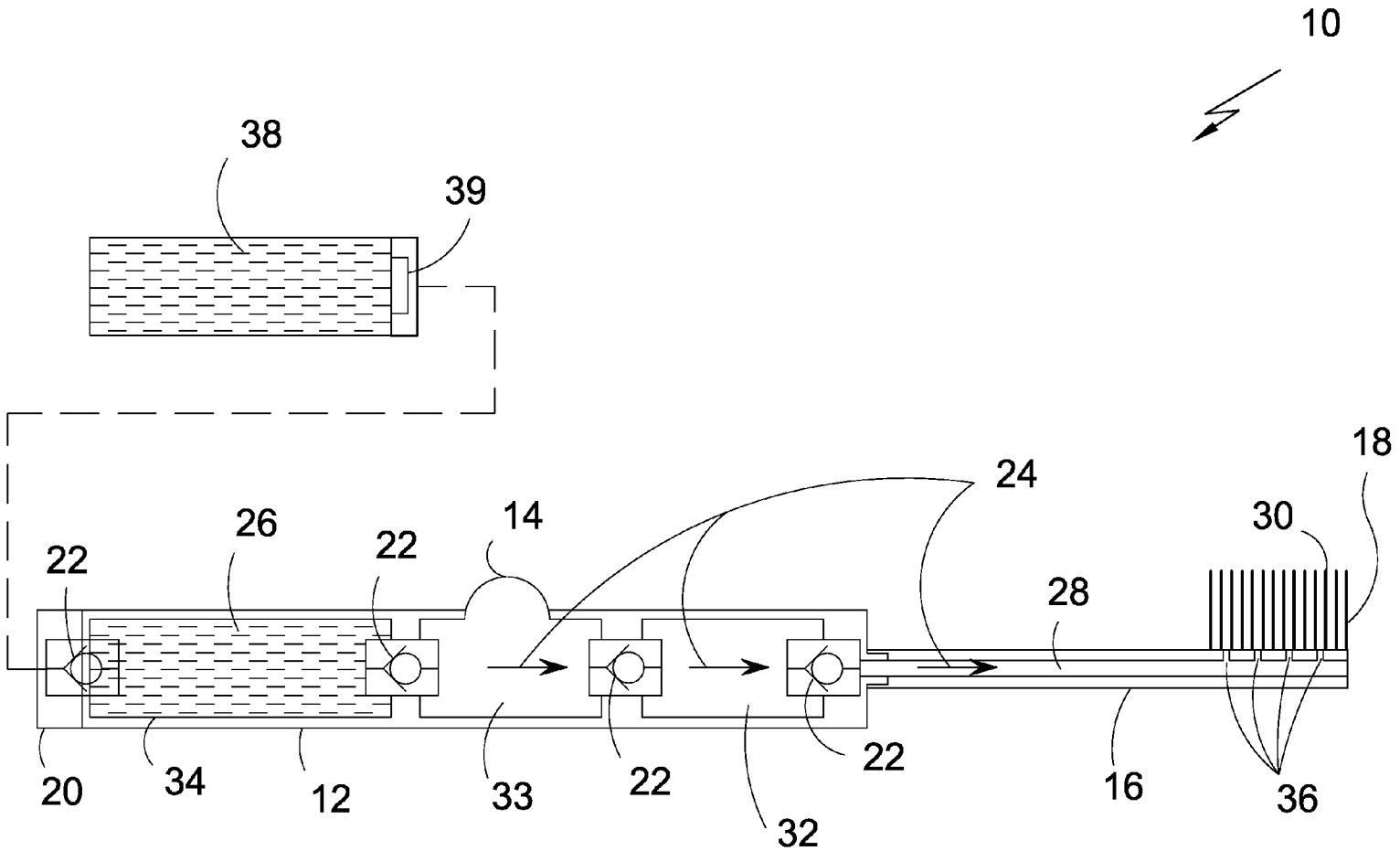
FIG. 2 is a block diagram of the toothbrush showing the detailed components of the present invention including position of liquid dentifrice refill, check valves, dosage chamber, holding chamber, actuator pump and flow direction.

FIG. 2 is a block diagram of the toothbrush of the present invention 10. Shown is a block diagram of the present invention 10 comprising a toothbrush having a handle 12 portion and a removable brush head portion 18. The handle 12 houses a dentifrice collapsible bag 34, a plurality of check valves 22 and reservoirs, including a dosage chamber 33 and holding chamber 32, each chamber using check valves as ingress and egress one way valves in fluid communication with a removable brush head 18 conduit 28 terminating in a plurality of apertures 36 located at the base of the brush 30. Also shown is a liquid dentifrice bag refill 38 having liquid dentifrice refill fastener 39 mateable to the handle end check valve 22 once the end cap 20 is removed.

Figure 3:
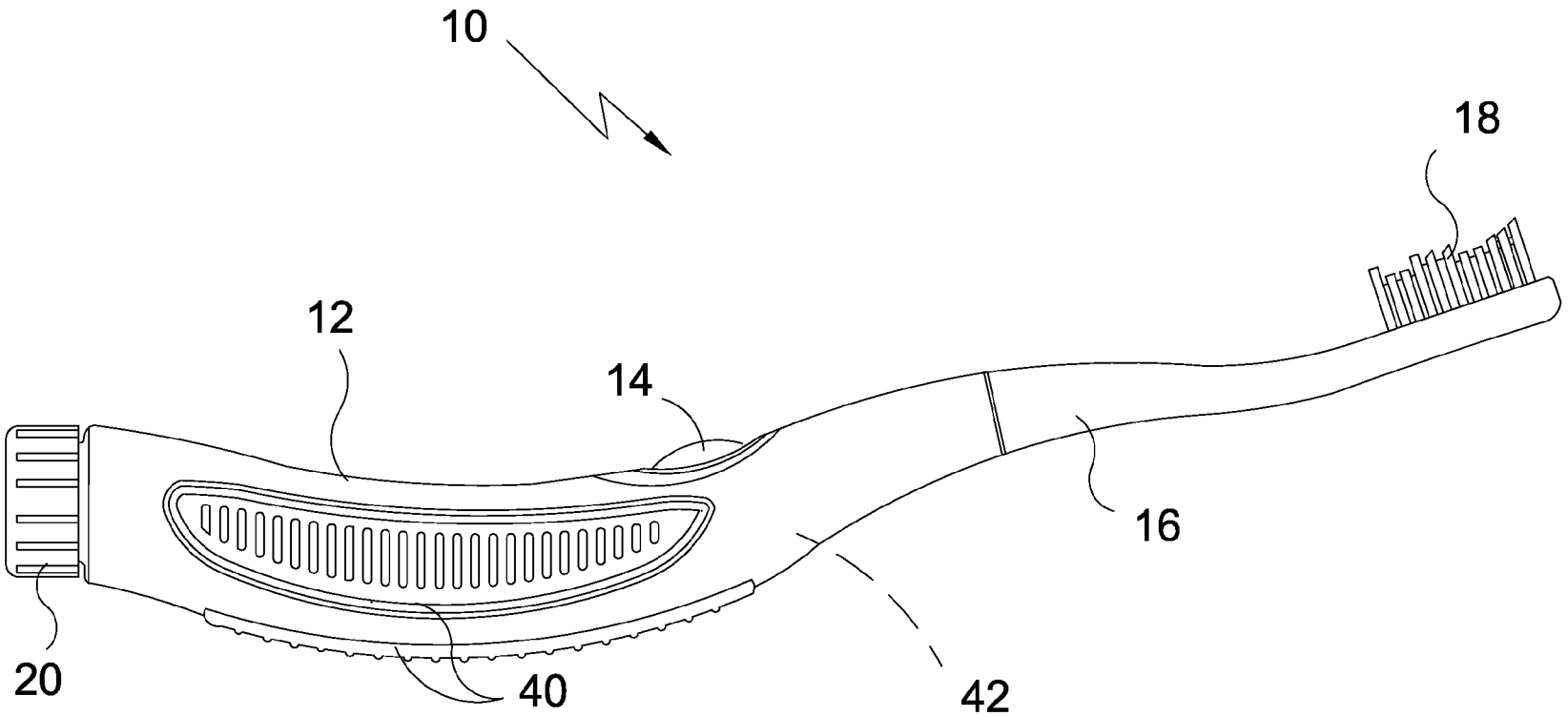
FIG. 3 is a side view of the toothbrush showing the toothbrush hand grip on the handle of the toothbrush.

FIG. 3 is a side view of the liquid dentifrice dispensing toothbrush. Shown is a side view of the present invention 10 depicting the liquid dentifrice dispensing toothbrush comprising a handle 12 portion and a removable brush head 18 portion with the handle 12 portion housing a pump assembly 42 having a pump actuator 14 within the wall of the handle 12. Also shown is the handle 12 having an end cap 20 providing access for refilling the liquid dentifrice reservoir.

Figure 4:
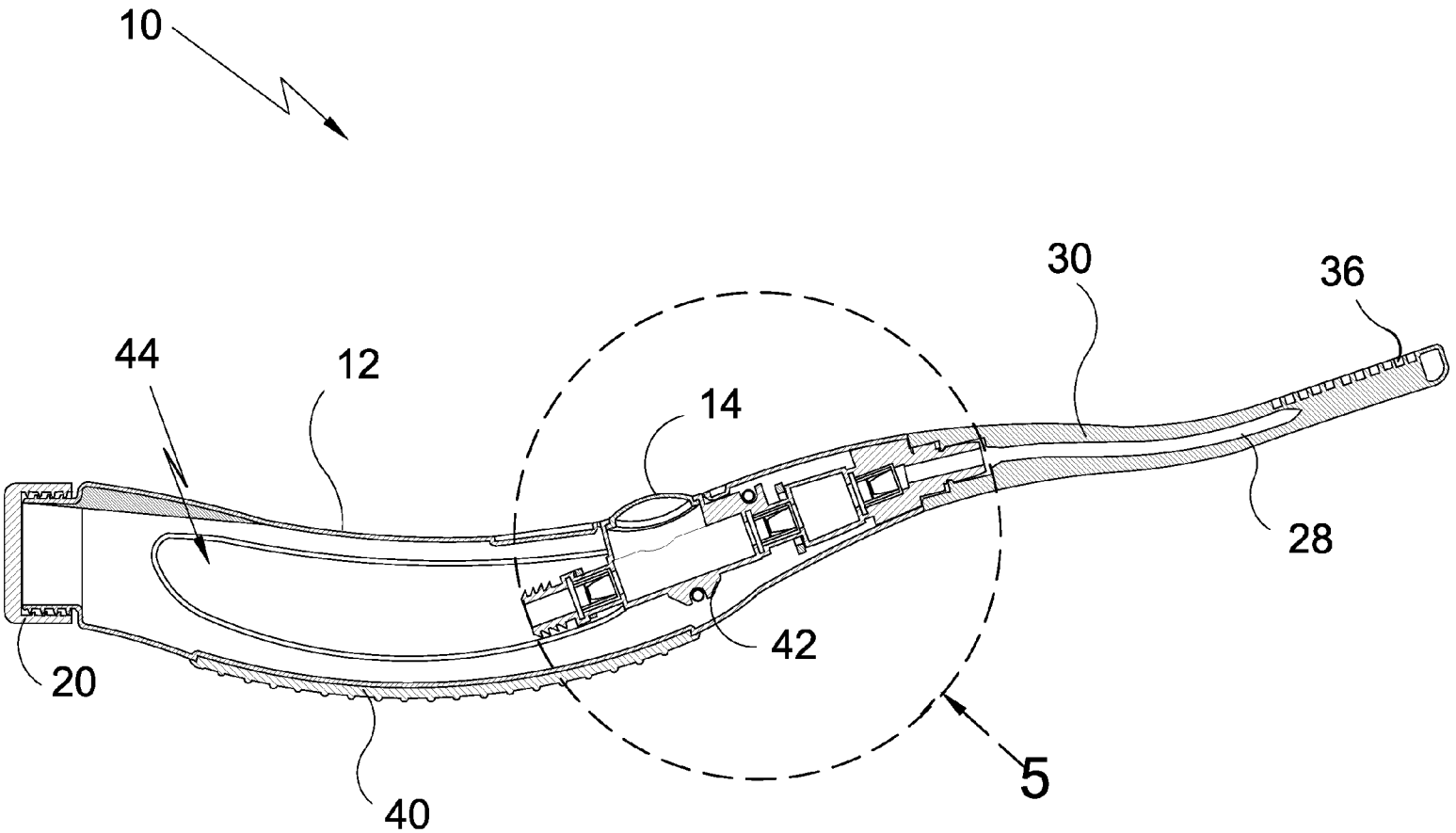
FIG. 4 is a side sectional view of the toothbrush showing the internal components of the present invention with pump assembly.

FIG. 4 is a side sectional view of the present invention 10. Shown is a side sectional view of the present invention 10 displaying the internal components of the device including a pump assembly 42 within a cavity 44 provided by the handle 12 housing for holding, pumping and delivering dentifrice through a provided conduit 28 and to the use via its apertures 36.

Figure 5:
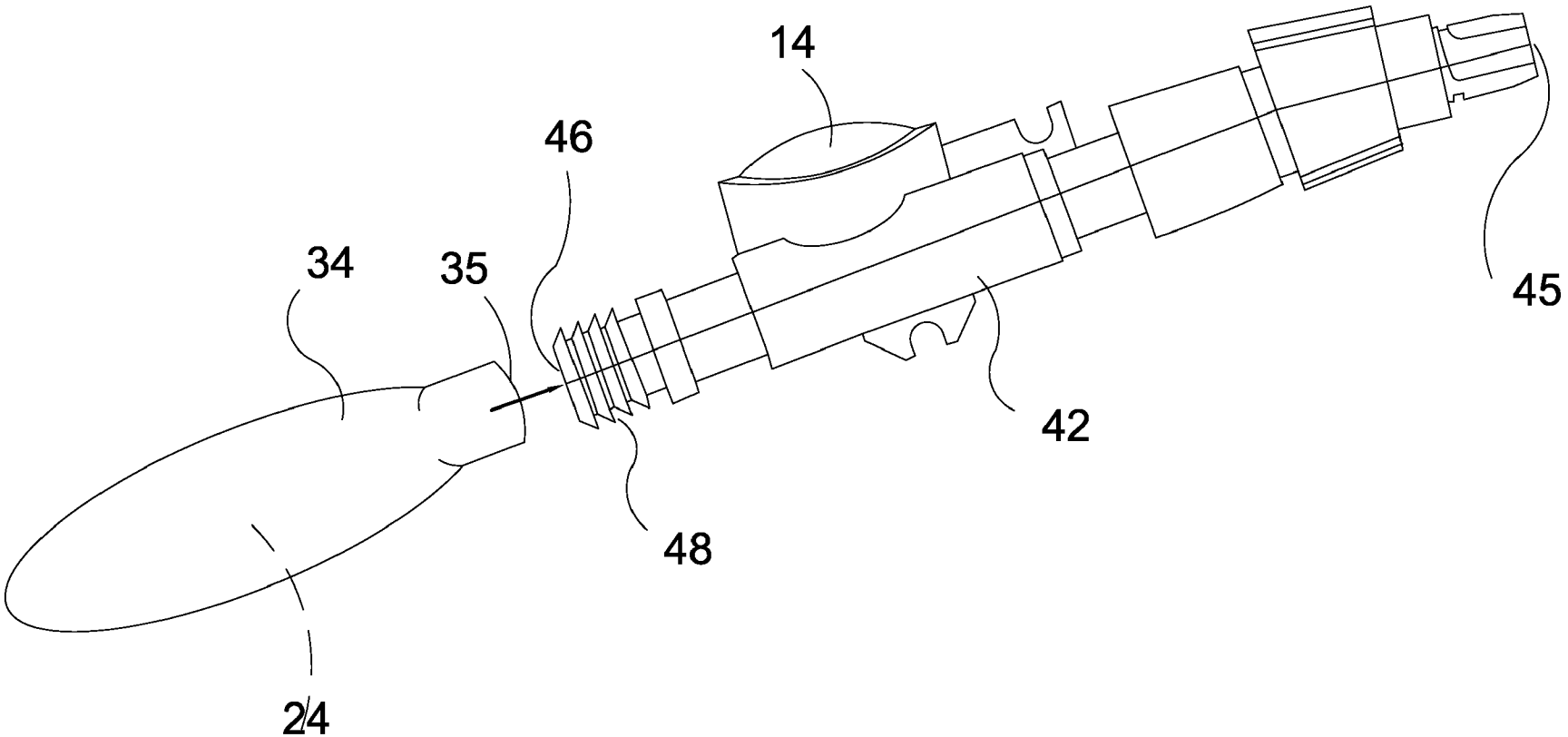
FIG. 5 is a side view of the toothbrush pump assembly showing the pump assembly components including dentifrice bag, inlet, pump button and outlet.

FIG. 5 is a side view of the pump assembly of the present invention 10. Shown is a side view of the pump assembly 42 having a nipple 48 for attachment thereto of a liquid dentifrice collapsible bag 34, via aperture 35, for holding and supplying liquid dentifrice 24 to the pump assembly 42 when needed.

Figure 6:
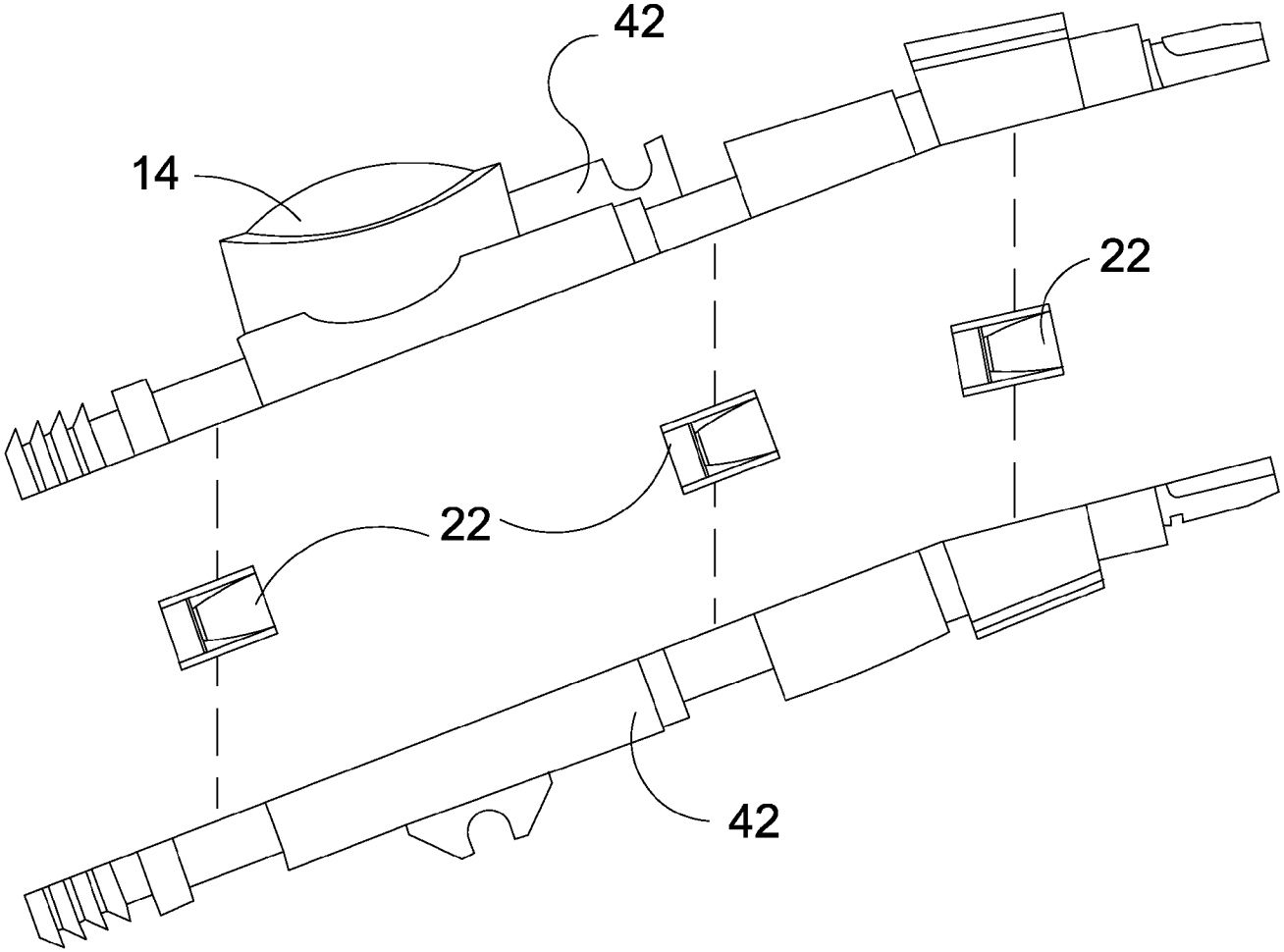
FIG. 6 is a side exploded view of the toothbrush pump assembly showing the one way valves.

FIG. 6 is a side exploded view of the pump assembly 42 of the present invention 42. Shown is a side exploded view of the pump assembly 42 comprising housing having a plurality of chambers and one way valves 22 with a pump actuator 14 providing means for moving the liquid dentifrice from the reservoir of liquid dentifrice to the brush bristles.

Figure 7:
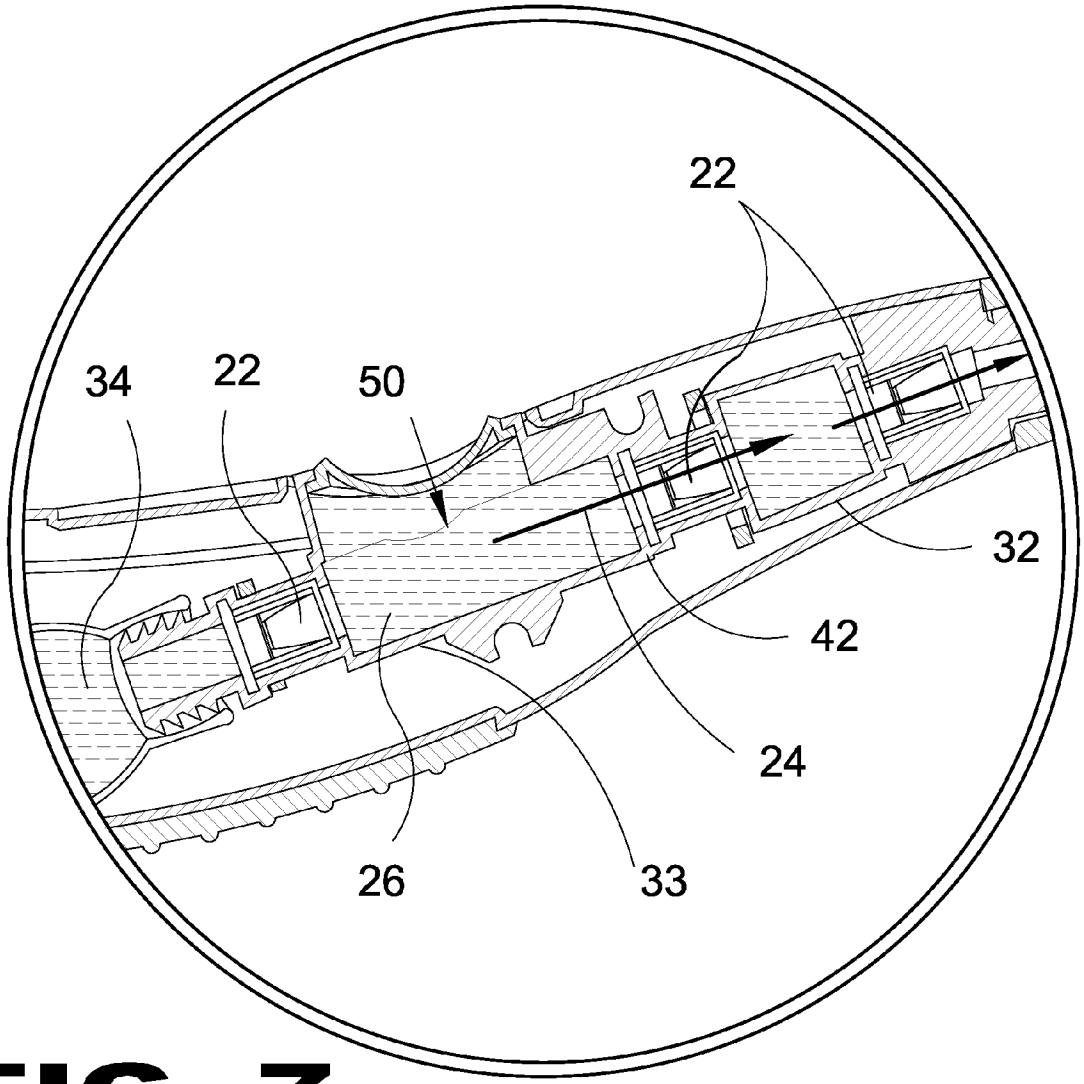
FIG. 7 is a side detailed view of the toothbrush pump assembly showing the path the dentifrice follows once the push button of the pump assembly is pressed.

FIG. 7 is a side detailed view of the pump assembly 42 of the present invention 10. Shown is a side detailed view of the pump assembly 42 of the present invention 10 depicting that when the pump actuator 14 is depressed, pressure 54 moves the liquid dentifrice 24 from the dosage chamber 33 to the holding chamber 32 with the holding chamber contents moved to the brush bristles.

Figure 8:
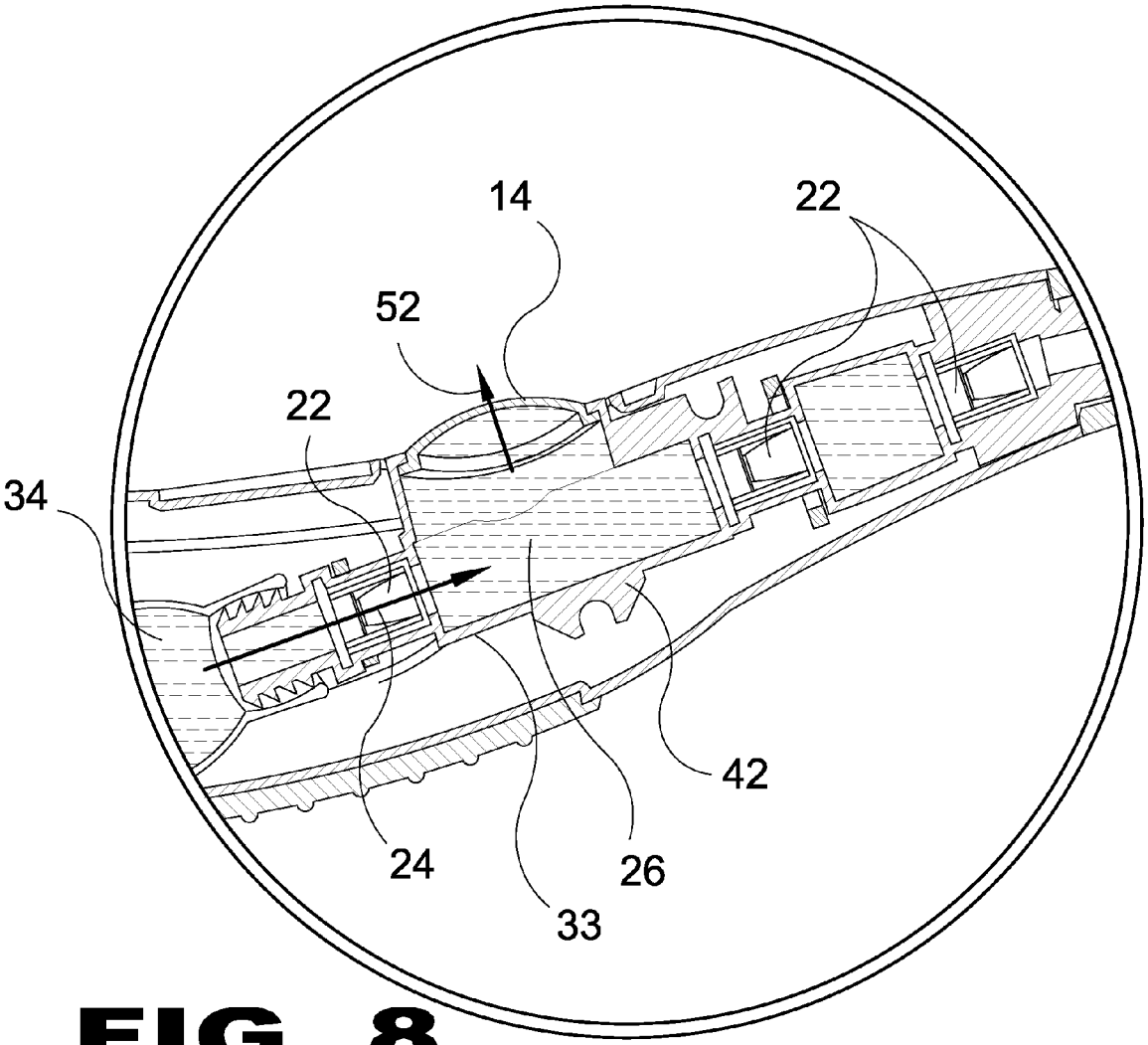
FIG. 8 is a side detailed view of the toothbrush pump assembly showing the collapsible bag refilling the pump assembly with fresh dentifrice.

FIG. 8 is a side detailed view of the pump assembly 42 of the present invention 10. Shown is a side detailed view of the pump assembly 42 of the present invention 10 depicting that when the pump actuator 14 returns to its original position a vacuum is created within the dosage chamber causing the dosage chamber 33 to refill with fresh liquid dentifrice 24 from the reservoir of liquid dentifrice.

Figure 9:
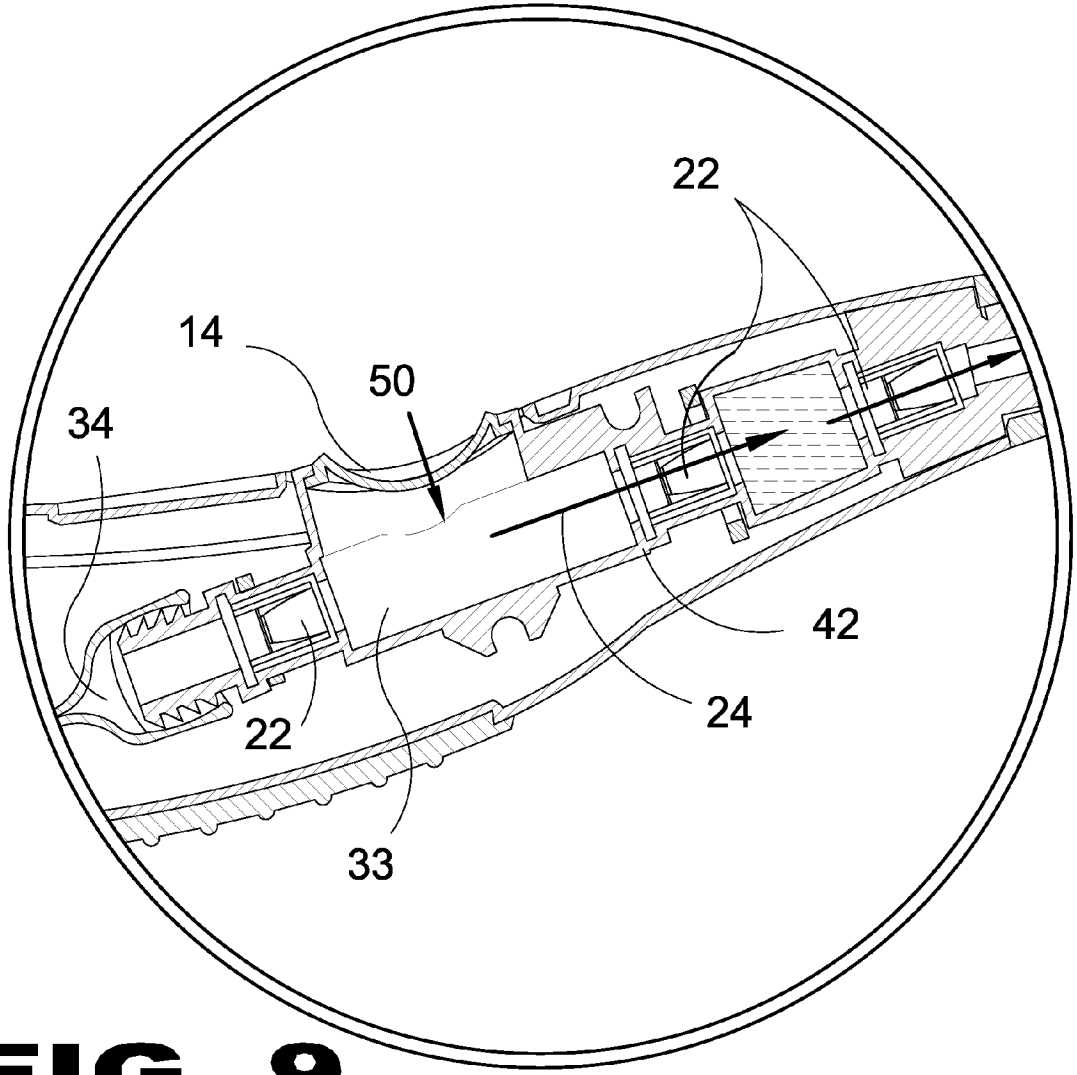
FIG. 9 is a side detailed view of the toothbrush pump assembly showing a depressed push button when the liquid dentifrice refill needs to be replaced.

FIG. 9 is a side detailed view of the pump assembly 42 of the present invention 10. Shown is a side detailed view of the pump assembly 42 of the present invention 10 depicting that when the pump actuator 14 is depressed with no dentifrice remaining in dentifrice collapsible bag 34, the vacuum created will keep the pliable button 14 in the depressed position thereby serving as an indicator that the dentifrice collapsible bag needs to be refilled.

What is claimed is new and desired to be protected by letters patent and is set forth in the appended claims:

1. A dentifrice dispensing toothbrush comprising:

a) a housing, the housing having a pump in communication with a holding chamber, a first check valve between said pump and said holding chamber, said pump having a pump nipple with a liquid dentifrice reservoir attached thereon, the liquid dentifrice reservoir is a collapsible bag, a check valve positioned between said collapsible bag and said pump, the housing having a removable cap to access said liquid dentifrice reservoir;

b) a head portion removeably attached to said housing, the head portion having bristles thereon, the head portion having a conduit in communication with said holding chamber, said conduit in communication with at least one opening in said bristles, a check valve positioned between said head portion and said holding chamber; and c) a pump actuator extending through a side of said housing.

2. The dentifrice dispensing toothbrush of claim 1, wherein the pump nipple has a plurality of outwardly extending ridges to secure the liquid dentifrice reservoir thereon.

3. The dentifrice dispensing toothbrush of claim 1, wherein the actuator is a pliable button.

4. A dentifrice dispensing toothbrush comprising:

a) a housing, the housing having a pump in communication with a holding chamber, a first check valve between said pump and said holding chamber, said pump having a pump nipple with a liquid dentifrice reservoir attached thereon, the liquid dentifrice reservoir is a collapsible bag, a check valve positioned between said collapsible bag and said pump, the housing having a removable cap to access said liquid dentifrice reservoir;

b) a head portion removeably attached to said housing, the head portion having bristles thereon, the head portion having a conduit in communication with said holding chamber, said conduit in communication with at least one opening in said bristles, a check valve positioned between said head portion and said holding chamber;

c) a pump actuator extending through a side of said housing; and d) said liquid dentifrice reservoir having a check valve mateable to a refill canister for the purpose of transferring contents of said refill canister to said liquid dentifrice reservoir.

5. The dentifrice dispensing toothbrush of claim 4, wherein the pump nipple has a plurality of outwardly extending ridges to secure the liquid dentifrice reservoir thereon.

6. The dentifrice dispensing toothbrush of claim 4, wherein the actuator is a pliable button.

* * * * *